United States Patent [19]

Grawe et al.

[11] Patent Number: 4,621,309

[45] Date of Patent: Nov. 4, 1986

[54] ELONGATED LUMINAIRE

[75] Inventors: Franz-Eugen Grawe; Manfred Grimm; Richard Schneppendahl; Fred Hasemann, all of Arnsberg, Fed. Rep. of Germany

[73] Assignee: Trilux-Lenze GmbH + Co. KG, Arnsberg, Fed. Rep. of Germany

[21] Appl. No.: 715,924

[22] Filed: Mar. 25, 1985

[30] Foreign Application Priority Data

Mar. 31, 1984 [DE] Fed. Rep. of Germany ..... 3412162

[51] Int. Cl.[4] ..... F21V 11/06; F21V 13/10

[52] U.S. Cl. ..... 362/342; 362/241; 362/248; 362/291; 362/292

[58] Field of Search ..... 362/260, 279, 290, 291, 362/292, 325, 342, 347, 217, 240, 241, 248, 301

[56] References Cited

U.S. PATENT DOCUMENTS

| | | | |
|---|---|---|---|
| 2,169,531 | 8/1939 | Jennings | 362/292 |
| 3,582,642 | 6/1971 | Johansson | 362/342 |
| 4,238,815 | 12/1980 | Price | 362/260 X |
| 4,268,897 | 5/1981 | Schierwagen et al. | 362/342 X |
| 4,429,354 | 1/1984 | Garnett | 362/342 |
| 4,494,175 | 1/1985 | Gawad et al. | 362/342 X |

FOREIGN PATENT DOCUMENTS

| | | | |
|---|---|---|---|
| 0021384 | 1/1981 | European Pat. Off. | 362/342 |
| 1809036 | 6/1970 | Fed. Rep. of Germany . | |
| 2630556 | 1/1978 | Fed. Rep. of Germany . | |
| 2655702 | 5/1979 | Fed. Rep. of Germany . | |
| 3030080 | 2/1982 | Fed. Rep. of Germany . | |
| 3412162 | 8/1985 | Fed. Rep. of Germany . | |
| 892536 | 3/1962 | United Kingdom . | |

OTHER PUBLICATIONS

*Illuminating Engineering* article, "Designing Low Brightness Luminaires For Higher Lighting Levels", Sep. 1959, pp. 580–581.

*Primary Examiner*—Willis R. Wolfe, Jr.
*Attorney, Agent, or Firm*—Collard, Roe & Galgano

[57] ABSTRACT

An elongated luminaire is provided having at least one fluorescent lamp and a louver arranged therebelow. The louver consists of lamp-parallel longitudinal reflectors and reflecting cross-oriented lamellae arranged transversely thereto and subsequently of V-shape in cross section. The lamella legs have a parabolic shape in cross section. A light guiding plate is provided extending from one leg of each cross-oriented lamella, extending diagonally upwardly towards and almost adjacent to the lamp. Each light guiding plate substantially overlaps the interspace between neighboring cross-oriented lamella in the vertical projection. Thus, the entire light flux, emerging downwards, is directed, depending on the position of the cross-oriented lamellae and of the light guiding plates, in the desired direction into the lower hemisphere so that it is possible to obtain different light distribution curves of symmetrical or asymmetrical shape with characteristic preferred directions.

4 Claims, 7 Drawing Figures

ELONGATED LUMINAIRE

The present invention relates to an elongated luminaire, having, at least, one fluorescent lamp and a louver, arranged therebelow, consisting of lamp-parallel longitudinal reflectors and reflecting cross lamellae, arranged transversely thereto and of substantially V-shape in cross section, the lamella legs of which being provided preferably with a parabolic shape, in cross section.

Such luminaire louvers form a protection from glare, by which particularly it is the intent that under a determined angle of vision a room illumination is substantially glarefree.

Luminaires as described above are known from DE-PS No. 26 55 702. Such louvers are formed by lamp-parallel longitudinal reflectors and reflecting cross lamellae arranged rectangularly thereto and of substantially V-shape in cross section, the lamella legs of which being parabolic in cross section. However, by such louvers only a part of the light flux is directed. The vertically emerging light flux portion of the lamp passes through the louvers unhindered and, therefore, may result in extreme brightening of areas arranged therebelow and may lead for example to reflected glare, if installed at a workplace.

It is also an object of such louvers to direct the light flux of the elongated fluorescent lamp in desired directions. That is effected without difficulty in the transverse direction of the lamp, due to the fact that the fluorescent lamp tubular in cross section has a relatively small dimension as compared with the cross section of the louver and, thus, is almost a point source of light. In the longitudinal direction the lamp is very large as compared with the interspace between two lamellae. Each lamella segment is illuminated from a lamp section, which is substantially longer than the lamella segment. Therefore, the directive efficiency of such a louver is very small in the longitudinal direction.

In the case of a workplace luminaire according to DE-OS No. 30 30 080 it has been proposed to direct, by inclination of the louver lamellae, the light flux in the longitudinal direction of the lamp in a more efficient manner. The light flux of the lamp in parallel or substantially in parallel with the inclined lamella plane emerges unhindered between the lamellae. Due to the fact that these lamellae overlap, no light actually emerges unhindered in the vertical direction. However, by zigzag reflections, a brightening of the lamellae occurs and, thus, light flux portions in undesired directions occur. In order to reduce this undesired portion, it has been proposed either to attach non-reflecting, i.e. black, auxiliary lamellae, or to provide the underside of the inclined lamellae as a non-reflecting underside. Both proposals lead to high loss of light. In particular, such brightening occurs in relatively large end regions due to direct light flux and zigzag reflections so that workplaces arranged thereunder obtain a high light flux portion from unfavorable angles, leading to reflected glare. Such brightening effects cannot be avoided by black auxiliary lamellae as described, which, in addition, increase the production cost of such louver and result in high losses of light.

By use of refractor plates on elongated fluorescent luminaires, it has been proposed according to DE-PS No. 26 30 556 to direct the light flux in the longitudinal direction of the lamp, in order to obtain light rays which are parallel as much as possible. However, in practice each prism effects a beam splitting by refraction. The prism as an optical system is very small in comparison with the light source. In addition to the light, which occurs in the desired direction only for a small angular range, for the remaining large angular range considerable dispersion and total reflection occur so that a very large portion of dispersion is superimposed on the desired light direction. The lightcircuit which cannot be avoided in such plastic refractor plates will also lead to such a high total brightening of the plate, thus causing glare effects at the workplace arranged thereunder.

It is the object of the present invention, in the case of a luminaire of the above described type, to direct to the lower hemisphere the predominant portion of the light flux of the lamps emerging downwards in the longitudinal direction with the louver so that only a very small light flux portion passes through the louver directly and unguidedly from the lamp, as seen in the longitudinal direction of the lamp.

This object, as well as others which will hereinafter become apparent, is accomplished in accordance with the present invention by a luminaire of the above mentioned kind in which on one leg of each cross-oriented lamella a light guiding plate is arranged, directed upwardly at an angle and extending almost adjacent to the lamp, which plate overlaps the interspace to the neighboring cross-oriented lamella in the vertical projection.

According to the present invention the elongated lamp is subdivided into sections by the light guiding plates which extend up to the vicinity of the lamp, each lamella or each lamella segment, respectively, being illuminated only by a determined short lamp section. Thus, the light directing "optical system" obtains only light flux from a limited solid angle range. According to the inclination of the light guiding plates the "shining" solid angle range may be changed in its position in relation to the light-directing optics. Thus, the desired main direction of radiation may be predetermined in accordance with the desired light distribution so that no or no appreciable light flux portion emerges directly from the louver. Consequently, such luminaires, with corresponding positioning of the cross lamellae with their light guiding plates are particularly suitable for the utilization as workplace luminaires in connection with VDU- (Visual Display Unit) screens, where increased demands on glare elimination are made.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 2:
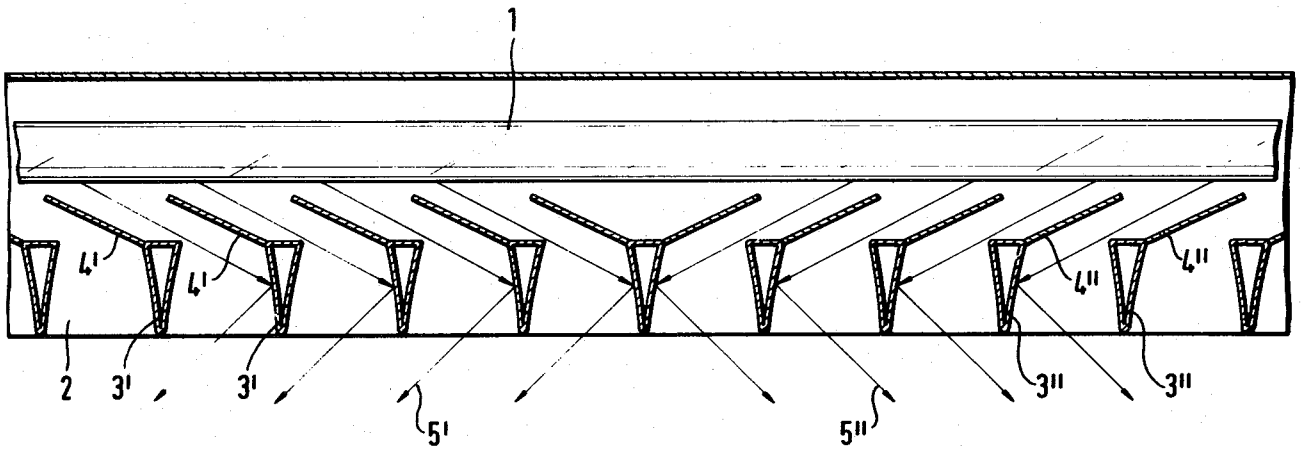
FIG. 2 is a similar cross-sectional view through a louver luminaire wherein the light flux distribution is directed outwards.
Figure 2A:
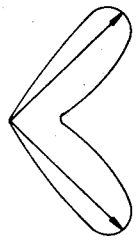
Figure 3:
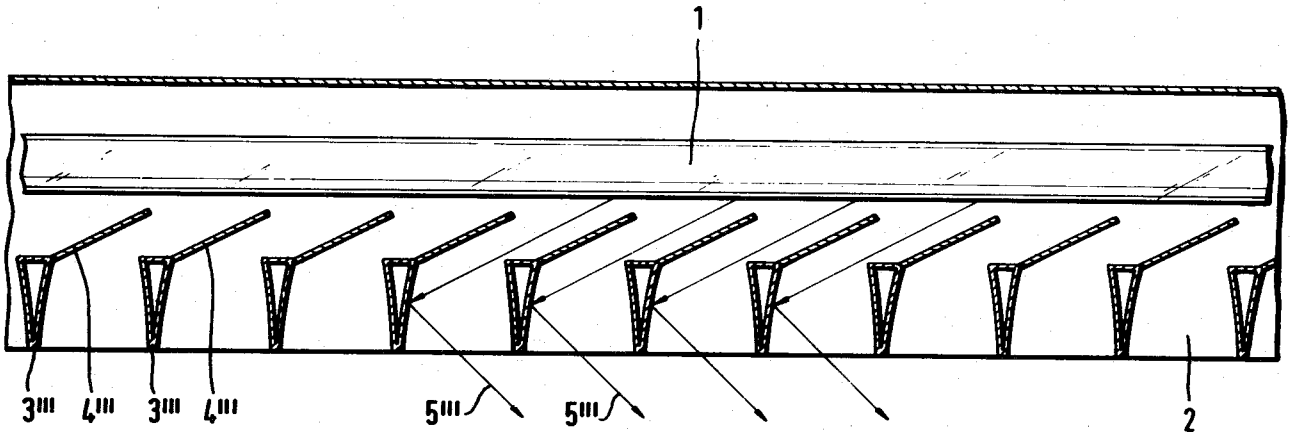
Figure 3A:
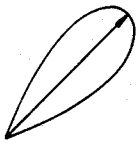
Figure 4:
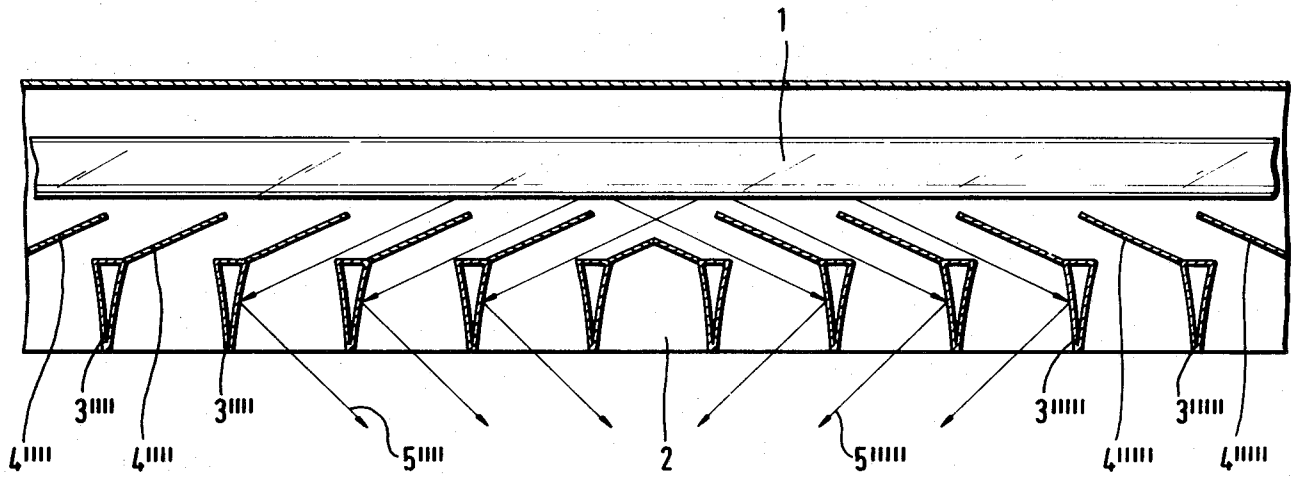
Figure 4A:
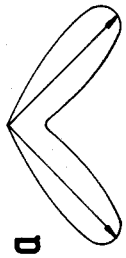

FIG. 2*a* is a representation of the light distribution curve of the luminaire of FIG. 2;

FIG. 3 is a partial longitudinal cross-sectional view through a louver luminaire having asymmetrical light flux distribution;

FIG. 3*a* is a representation of the light distribution curve of the luminaire of FIG. 3;

FIG. 4 is a partial longitudinal cross-sectional view through a louver luminaire with light flux distribution directed inwards; and FIG. 4*a* is a representation of the light distribution curve of the luminaire of FIG. 4.

Figure 1:
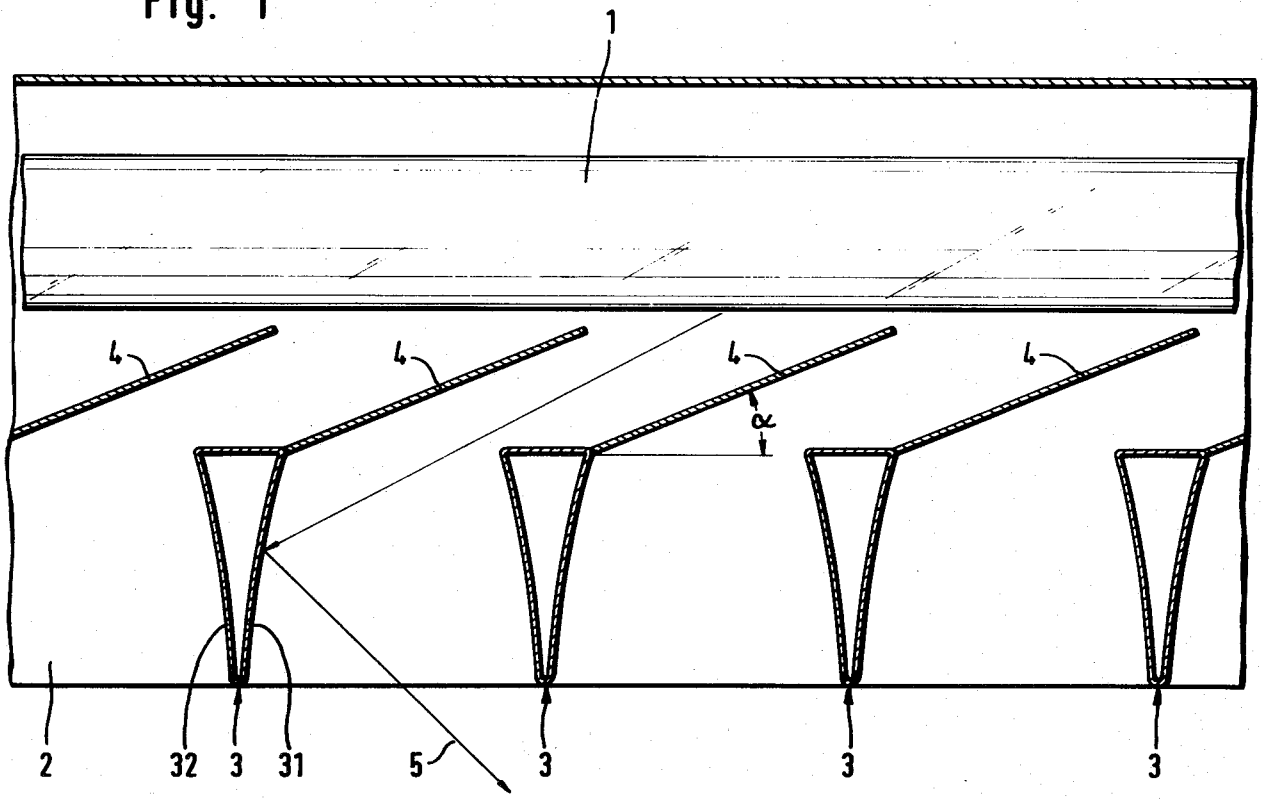
FIG. 1 is a partial longitudinal cross-sectional view through a louver luminaire, light guiding plates in parallel with one another being formed on the cross-oriented lamellae thereof.

Now turning to the drawings, there is shown in FIG. 1 a louver, located below lamp 1 and held in a housing (not shown). The louver is formed by lamp-parallel longitudinal reflectors 2 and cross-oriented lamellae 3, arranged rectangularly thereto and of V-shape in cross section. Legs 31 and 32 of cross-oriented lamellae 3, forming reflectors, are parabolic in cross section. Preferably the lamellae consist of high-gloss mirror material or of mirror material of satin finish. In each case on a leg 31 of cross-oriented lamellae 3 light guiding plates 4 are arranged inclined upwardly at an angle $\alpha$ to the horizontal, which plates extend almost up to lamp 1.

In order to prevent direct light from lamp 1 emerging outwardly through the interspace between two neighboring cross-oriented lamellae 3, light guiding plates 4 are dimensioned so that they overlap the interspace between neighboring cross-oriented lamellae 3 in the vertical projection. As can be seen by rays 5, in the case of the luminaire as illustrated, predominantly on the lamella leg 31 reflected light emerges from the louver in the longitudinal direction of the lamp 1. By the parallel arrangement of light guiding plates 4 to one another, an effective rectification of the light flux emerging as reflected flux is obtained.

In order to obtain a light flux distribution based on a cross axis of symmetry and directed outwardly, two louver sections may be provided on a louver as clearly seen in FIG. 2. On the right-hand side of the axis of symmetry light guiding plates 4'' on cross-oriented lamellae 3'' extend diagonally to the top right so that a light flux direction results substantially according to the ray 5''. On the left-hand side of the axis of symmetry, light guiding plates 4' on cross-oriented lamellae 3' are directed diagonally to the top left towards lamp 1. This arrangement results in a light flux direction according to ray 5'.

An asymmetrical light flux control is achieved by a louver luminaire according to FIG. 3. All light guiding plates 4''' extend in parallel with one another diagonally to the top right, extending up to lamp 1. A directive effect according to rays 5''' results. The light distribution corresponds to the light distribution curve according to FIG. 3*a*.

A louver luminaire according to FIG. 4 may be used particularly as a workplace luminaire. The louver of this luminaire again is subdivided into two sections with respect to lamp 1. On the right-hand side of the axis of symmetry on cross-oriented lamellae 3''''', light guiding plates 4''''' are provided diagonally to the top left, extending towards and almost up to lamp 1. On the left-hand side of the axis of symmetry on cross-oriented lamellae 3'''', light guiding plates 4'''' are provided diagonally to the top right, extending towards and almost up to lamp 1. The indicated rays 5'''' and 5''''' show the characteristic preferred directions of the light distribution curve according to FIG. 4*a*. Such a light distribution is desirable particularly for workplace luminaires.

Generally there is also the possibility to subdivide the louvers of the present invention into a plurality of regions with light guiding plates in parallel with one another or directed against one another, respectively. The spaces of the cross-oriented lamellae may also be constant or different.

Furthermore, there is the possibility to arrange the cross-oriented lamellae of the louver so that they are not rectangular with respect to the longitudinal direction of the lamp, so as to thereby obtain, diagonally to the horizontal projection plane of the luminaire, an asymmetrical light distribution.

While several embodiments of the present invention have been shown and described, it will be obvious that many changes and modifications may be made thereunto without departing from the spirit and scope of the invention.

What is claimed is:

1. In an elongated luminaire having at least one fluorescent lamp and a louver arranged therebelow, the louver consisting of lamp-parallel longitudinal reflectors and reflecting cross lamellae arranged transversely thereto and of substantially V-shape in cross section, the lamella legs of which having a parabolic shape in cross section, the improvement comprising a light guiding plate arranged on one leg of each cross lamella extending upwardly at an angle and substantially adjacent to the neighboring cross lamella in the vertical projection.

2. The luminaire according to claim 1, wherein all guiding plates are arranged parallel with one another.

3. The luminaire according to claim 1, wherein the guiding plates in specific regions of said louver are directed opposite to the guiding plates in other specific regions.

4. The luminaire according to claim 1, wherein said guiding plates are formed on a specific leg of the cross lamellae.

* * * * *